United States Patent [19]

Tsukui

[11] Patent Number: 4,983,053

[45] Date of Patent: Jan. 8, 1991

[54] PASSBOOK PRINTING MACHINE

[75] Inventor: Setsuo Tsukui, Kawasaki, Japan

[73] Assignee: Fujitsu Limited, Kawasaki, Japan

[21] Appl. No.: 483,331

[22] Filed: Feb. 20, 1990

Related U.S. Application Data

[63] Continuation of Ser. No. 240,482, Sep. 6, 1988, abandoned, which is a continuation of Ser. No. 5,794, Jan. 27, 1987, abandoned.

[30] Foreign Application Priority Data

Jan. 22, 1986 [JP] Japan ..... 61-011668

[51] Int. Cl.[5] ..... B41J 5/30

[52] U.S. Cl. ..... 400/62; 109/24.1; 235/379

[58] Field of Search ..... 400/605, 595, 23, 61, 400/62, 67–68; 109/24.1; 235/379, 432, 382.5, 419, 487

[56] References Cited

U.S. PATENT DOCUMENTS

| | | | |
|---|---|---|---|
| 4,441,829 | 4/1984 | Hebert, Jr. et al. | 400/68 |
| 4,508,962 | 4/1985 | Yamasaki | 235/432 |
| 4,540,106 | 9/1985 | Fukatsu | 109/24.1 |
| 4,553,860 | 11/1985 | Imaizumi et al. | 400/68 |
| 4,578,567 | 3/1986 | Granzow et al. | 235/379 |
| 4,634,845 | 1/1987 | Hale et al. | 235/379 |
| 4,689,478 | 8/1987 | Hale et al. | 235/379 |
| 4,746,787 | 5/1988 | Suto et al. | 235/379 |
| 4,761,542 | 8/1988 | Kubo et al. | 235/379 |
| 4,864,109 | 9/1989 | Minematsu et al. | 235/379 |

OTHER PUBLICATIONS

Patent Abstracts of Japan, vol. 10, No. 316 (P-510) [2372], Oct. 28, 1986; & JP-A-61 125 681 (Oki Electric Ind. Co. Ltd.) 06—13-86.

Patent Abstracts of Japan, vol. 4, No. 131 (P-27) [613], Sep. 13, 1980; & JP-A-55 82 373 (Tokyo Shibaura Denki K.K.) 06-21-80.

Patent Abstracts of Japan, vol. 5, No. 104 (P-69) [776], Jul. 7, 1981; & JP-A-56 47 862 (Sharp K.K.) 04-30-81.

*Primary Examiner*—Eugene H. Eickholt

*Attorney, Agent, or Firm*—Staas & Halsey

[57] ABSTRACT

A passbook printing machine which executes a transaction by user manipulation with the use of a passbook, and the passbook is returned to the user after transaction data is printed therein. The machine comprises a printer for printing the transaction data in the passbook and a controller which selects either a brief printing mode or an ordinary printing mode. In the brief printing mode, only the latest transaction data is printed in the passbook, and in the ordinary printing mode, not-printed former transaction data is print-out in addition as the latest transaction data. The controller selectively executes one of the printing modes in response to a user's command.

11 Claims, 16 Drawing Sheets

Fig. 1A

| DATE | WTHDWL | DEPOSIT | BALANCE | |
|---|---|---|---|---|
| 850710 | 1,000 | | 20,000 | ← PRINTED FORMER DATA |
| 850810 | 10,000 | | BRIEF PRT. | ← LATEST DATA |

Fig. 1B

| DATE | WTHDWL | DEPOSIT | BALANCE | |
|---|---|---|---|---|
| 850710 | 1,000 | | 20,000 | ← PRINTED FORMER DATA |
| 850715 | 5,000 | | 15,000 | NOT-PRINTED FORMER DATA |
| 850715 | | 10,000 | 25,000 | |
| 850730 | 10,000 | | 15,000 | |
| 850810 | 10,000 | | 5,000 | ← LATEST DATA |

Fig. 7(B)

| | DATE | | WTHDWL | DEPOSIT | BALANCE | |
|---|---|---|---|---|---|---|
| 1 | 850710 | N B | TRANSFER | 50,000 | 100,000 | FORMER DATA |
| 2 | 850712 | N B | 30,000 | ATM | 70,000 | |
| 3 | 850730 | | 10,000 | QUICK S. | BRIEF PRT. | ←LATEST DATA |
| 4 | | | | | | |
| 5 | | | | | | |
| 6 | | | | | | |
| 7 | | | | | | |
| 8 | | | | | | |
| 9 | | | | | | |
| 10 | | | | | | |
| 11 | | | | | | |
| 12 | | | | | | |
| 13 | | | | | | |

Fig. 8(B)

| | DATE | | WTHDWL | DEPOSIT | BALANCE | |
|---|---|---|---|---|---|---|
| 1 | 850710 | N B | TRANSFER | 50,000 | 100,000 | PRINTED FORMER DATA |
| 2 | 850712 | N B | 30,000 | ATM | 70,000 | |
| 3 | 850715 | N B | 5,000 | ELECT CHGE | 65,000 | NOT-PRINTED FORMER DATA |
| 4 | 850715 | N B | 4,000 | GAS CHGE | 61,000 | |
| 5 | 850720 | N B | TRANSFER | 150,000 | 211,000 | |
| 6 | 850721 | N B | 50,000 | CARD | 161,000 | |
| 7 | 850725 | N B | 20,000 | CREDIT | 141,000 | |
| 8 | 850730 | N B | 10,000 | ATM | 131,000 | ← LATEST DATA |
| 9 | | | | | | |
| 10 | | | | | | |
| 11 | | | | | | |
| 12 | | | | | | |
| 13 | | | | | | |
| 14 | | | | | | |

PASSBOOK PRINTING MACHINE

This is a cont. of copending application Ser. No. 240,482 filed on Sept. 6, 1988, now abandoned, which is a cont. of Ser. No. 005,794 filed Jan. 27, 1987 and now abandoned.

BACKGROUND OF THE INVENTION

1. Field of the Invention

The present invention relates to a passbook printing machine by which transactions are automatically executed upon user operation, using a passbook as a transaction medium. In particular, it relates to a passbook printing process wherein the printing time can be shortened to thus reduce the transaction time.

2. Description of the Related Art

Automatic machines provided with a means for printing on a passbook are widely utilized in the banking field. In this operation, the user inserts a card or a passbook into the automatic machine, which then executes an automatic transaction, and after the transaction is completed, the transaction details are printed in the passbook, which is then returned to the user.

In the process of such an automatic transaction, desirably the transaction time is as short as possible.

FIG. 9 is a flow chart of a prior art sequence of a transaction function executed by an automatic machine using a passbook. The sequence is begun by the insertion of the passbook by the user and is ended when the passbook is returned to the user.

First, the passbook is inserted into the machine and a magnetic stripe provided on the passbook is read by the machine to check the passbook data. Various data, such as a branch code, an account number, a validity code, and an identification number are recorded on the magnetic stripe, and therefore, the validity of the passbook and the account number can be checked by reading that data.

When the validity is confirmed by the check, the user then inputs an identification number (secret number), which is compared with the number recorded on the passbook. When the check is positive, the machine determines that there are no obstacles to starting a transaction.

Subsequently, the user inputs a desired transaction amount, which is the final step in the input operation process.

The machine then communicates with a host computer in accordance with the input data, and the host computer identifies the account number, renews the data, determines the permission/rejection of the transaction, and then transmits direction signals. If a transaction permission signal is received, the machine carries out the transaction by, e.g., counting and discharging bills. Then the transaction data is printed in the passbook, and subsequently, the passbook is discharged from of the machine to end the transaction.

In the process of printing the transaction data, former transaction data not printed in the passbook, if any, is transmitted to the automatic machine from the host computer as well as the latest transaction data and both are printed in the passbook.

The amount of not-printed former transaction data is increasing these days since the majority of cash transactions is usually carried out through automatic transfer machines without using a passbook.

Therefore, the printing time is increased when conducting a transaction using the passbook, which is undesirable for a busy person or when other persons are waiting to use the automatic machine.

SUMMARY OF THE INVENTION

An object of the present invention is to provide a passbook printing process in an automatic machine which makes it possible to shorten the overall transaction time by providing a brief printing mode wherein former not-printed data is not printed in the passbook.

In accordance with the present invention, there is provided a passbook printing process in an automatic machine which executes a transaction by user manipulation, by using a passbook which is returned to the user after the transaction data is printed therein. The machine comprises a printer for printing transaction data in said passbook and a controller which selects either a brief printing mode or an ordinary printing mode wherein, in the brief printing mode, only the latest transaction data is printed in the passbook, whereas in the ordinary printing mode, not-printed former transaction data is printed in addition to the latest transaction data; the controller selectively executing one of the printing modes in response to a user command.

BRIEF DESCRIPTION OF THE DRAWINGS

FIGS. 1A and 1B are explanatory views of the principle of the present invention;

FIGS. 2(A) and 2(B) of an embodiment of the present invention;

FIGS. 4(A)-1, 4(A)-2, 4(B)-1 and 4B-(2) are flow charts of a transaction process according to the present invention;

FIGS. 7(A) and 7(B) are explanatory views of a passbook printing mode in a quick service operation;

FIGS. 8(A) and 8(B) are explanatory views of passbook printing mode in an ordinary service operation; and, FIG. 9 is an explanatory view of a prior art process.

DESCRIPTION OF THE PREFERRED EMBODIMENTS

Figures 1, 4A:
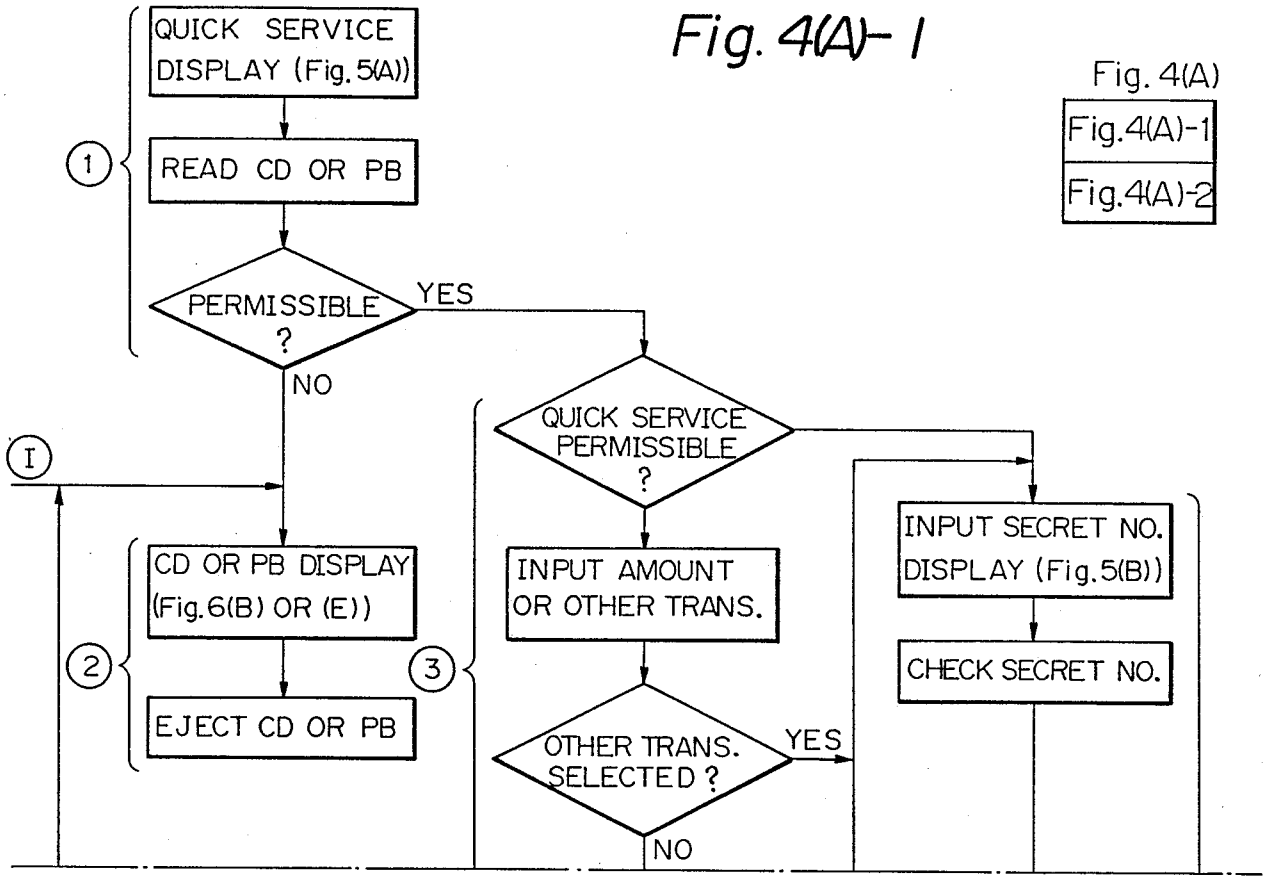

A principle of the present invention is described hereinafter with reference to FIG. 1, wherein FIG. 1(A) represents a brief printing mode wherein only a latest transaction data is printed in a passbook PB, and FIG. 1(B) represents an ordinary printing mode wherein both not-printed former transaction data and the latest transaction data are printed in the passbook PB. Either mode can be selected in response to a user command.

The selection of the printing mode can be made by either reading information data memorized on a magnetic stripe provided on the passbook, or by an input of the desired mode through input-keys, by the user.

In accordance with the present invention, the user can command a data print-out in the brief printing mode, and therefore, the printing time is shortened, thus reducing the overall transaction time and reducing delays for a busy person or when many persons are waiting to use the machine.

Figures 2, 4A:
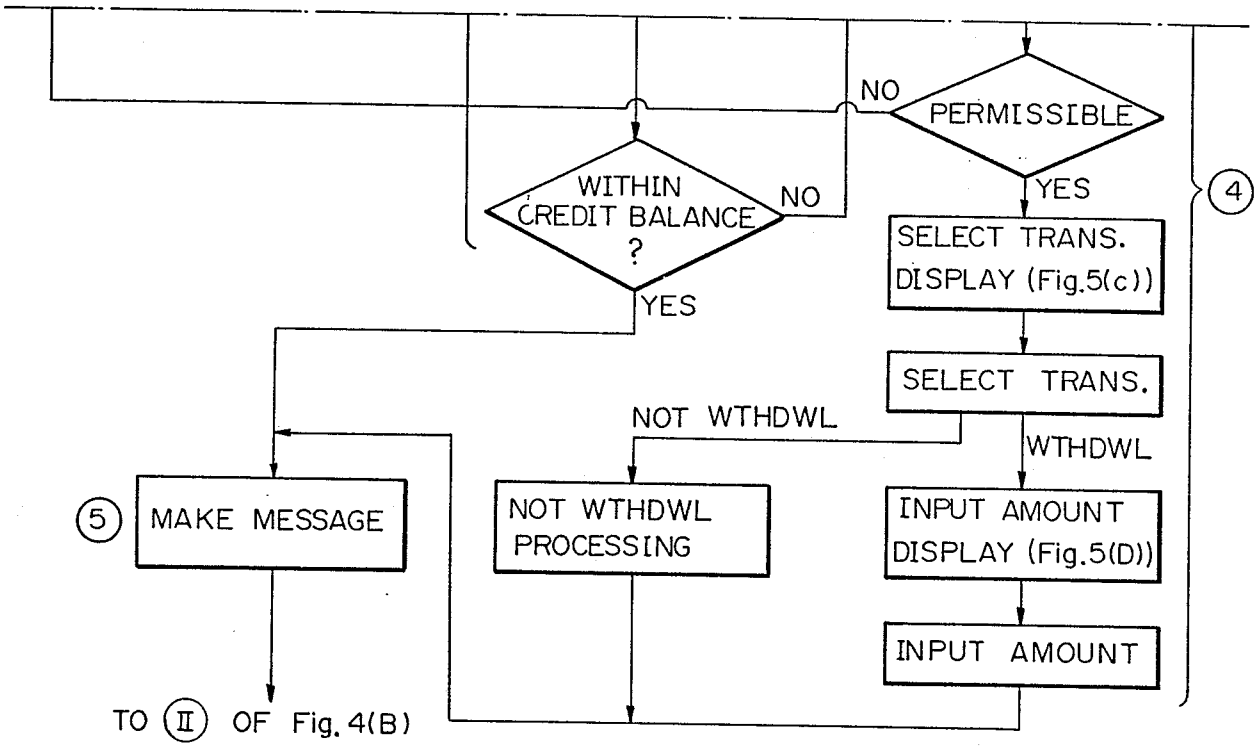
FIG. 2 is a block diagram showing FIGS. 2(A) and 2(B).
FIGS. 4(A) and 4(B) are block flow diagrams of FIGS. 4(A)-1 and 4(A)-2 and 4(B)-1 and 4(B)-2 respectively.

An embodiment of a deposit and withdrawal automatic machine used in the present invention is illustrated in FIGS. 2(*a*)–2(*b*). Numeral 1 designates a card reader-imprinter-printer (CIP). A card CD having a magnetic stripe thereon is inserted into the CIP 1 which reads data written on the magnetic stripe of the card CD, imprints the embossed number on a receipt, and prints the transaction data on the receipt, which is then dispensed to the user together with the card CD. Numeral 2 designates a passbook printer. A passbook PB having a magnetic stripe thereon is inserted into the printer 2, which reads data written on the magnetic stripe of the passbook PB and prints the transaction data in the passbook PB, which is then dispensed to the user. Numeral 3 designates a cash counter for counting paper currency PC from a bill container and dispensing bills in accordance with the transaction order. Numeral 4 designates an envelope depository which first ejects an envelope and then ingests it after the user has enclosed paper currency PC or a check CH therein. An operation panel 5 comprises first input-keys 52 for guiding the operation of the machine by the user, and disposed on both sides of a display 51 and second input keys 50 for data input by the user.

Numeral 60 designates a main controller comprising a micro-computer which controls the functions of the machine in accordance with a program. Numeral 61 designates a card controller which controls the functions of the CIP 1 in accordance with a control signal from the main controller 60. The main controller 60 also controls a passbook controller 62 for operating the passbook printer 2, a dispense controller 63 for operating the envelope depository 4, and an operation controller 65 connected to the operation panel 5. Numeral 66 designates a memory for memorizing program data required for operating the main controller 60. The memory 66 comprises a transaction indication register **66*a*, a magnetic strip buffer 66*b*, and a communication buffer 66*c*. Numeral 67 designates a circuit controller through which the communication with a host computer is conducted in accordance with the commands from the main controller 60. Numeral 68 designates floppy disc drive which constitutes an external memory device in which floppy disc 68*a* and 68*b* are set. The floppy disc 68*a* stores, for example, forbidden account numbers and bank table off-line transaction data. The floppy disc 68*b* stores, for example, programs for operation of the machine. A floppy disc controller (not shown) controls the floppy disc drive 68 for read and write operations forward to the floppy discs 68*a* and 68*b* in accordance with commands from the main controller 60**.

Accordingly, this automatic transaction machine has a medium treatment section comprising the CIP 1 and the passbook printer 2, a dispensing section comprising the cash counter 3, a deposit section comprising the envelope depository 4, and an operation section comprising the operation panel 5. The automatic transaction machine constitutes a multi-function machine for the deposit, withdrawal and transferring of money with the use of a card or passbook.

Figure 2A:
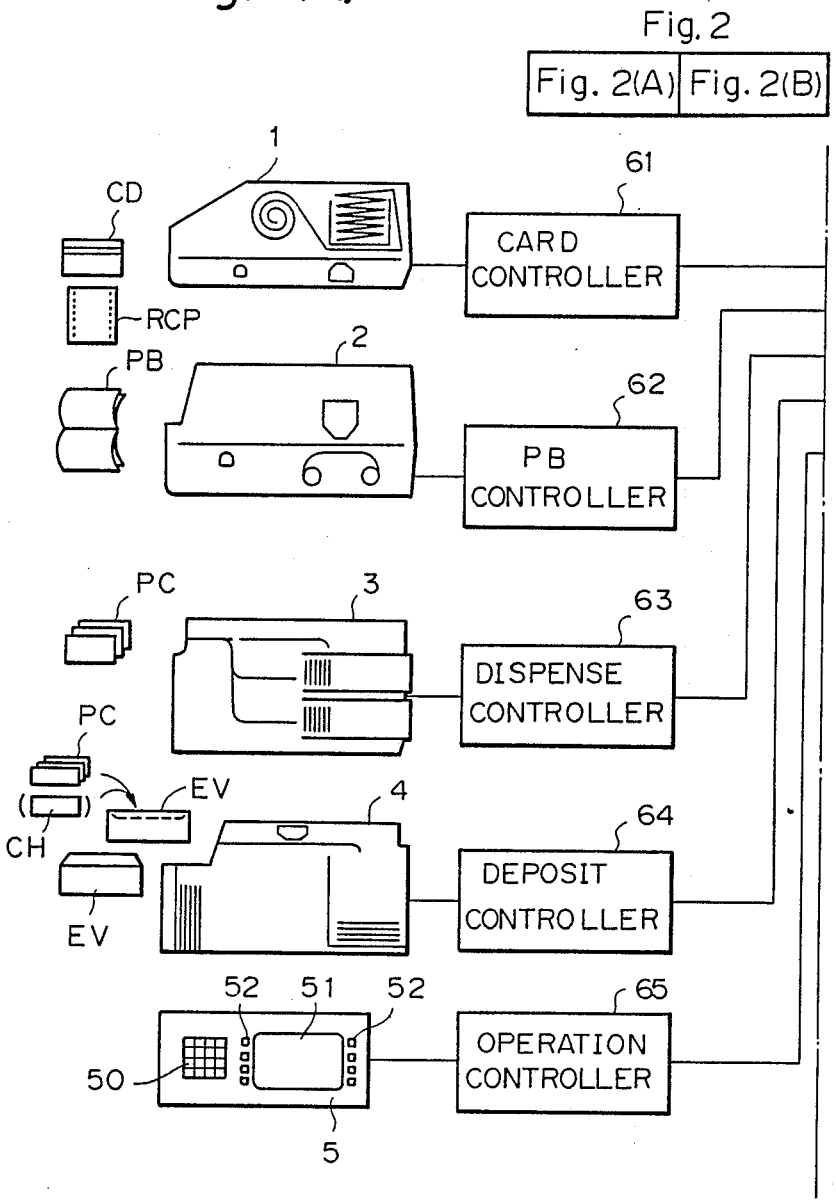
FIGS. 2(A) and 2(B) are constructional views of the present invention.
Figure 2B:
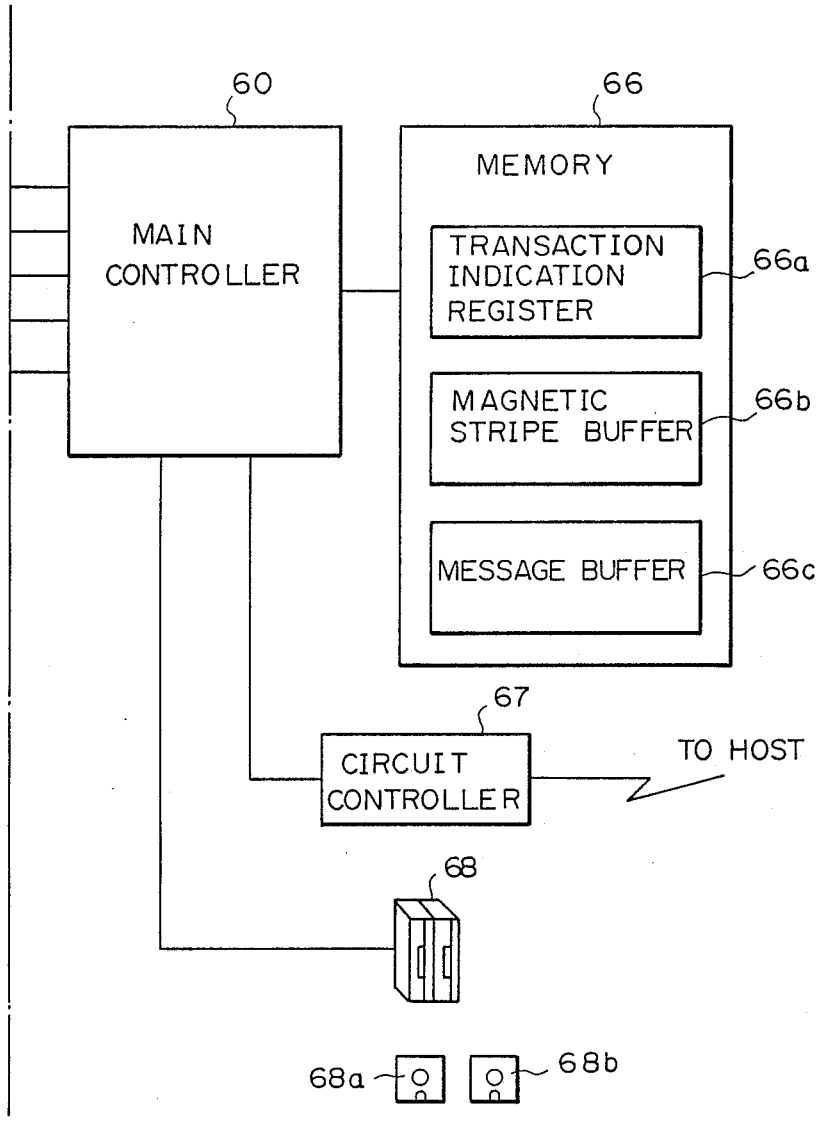
Figure 3A:
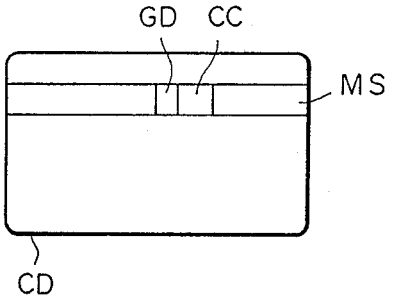
FIGS. 3A and 3B are explanatory views of a transaction medium used in the present invention.
Figure 3B:
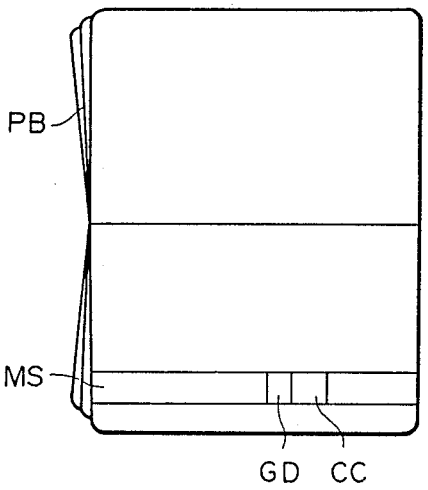

Referring now to FIGS. 3(A) and 3(B), the card CD has a magnetic stripe MS thereon, as illustrated in FIG. 3(A). Transaction data, such as the grade of the customer (GD) and credit balance (withdrawal amount from the credit amount during a predetermined term) (CC) are recorded on the magnetic stripe MS.

The passbook PB has a similar magnetic stripe MS on the back cover thereof, as illustrated in FIG. 3(B).

The grade of the customer GD is qualification data, and selection of the first transaction mode, including the brief printing mode, is permissible only for a user having a predetermined grade GD.

The credit balance CC restricts the withdrawal amount through the first transaction mode to minimize losses if the transaction medium (card or passbook) is lost or stolen.

Figures 1, 4B:
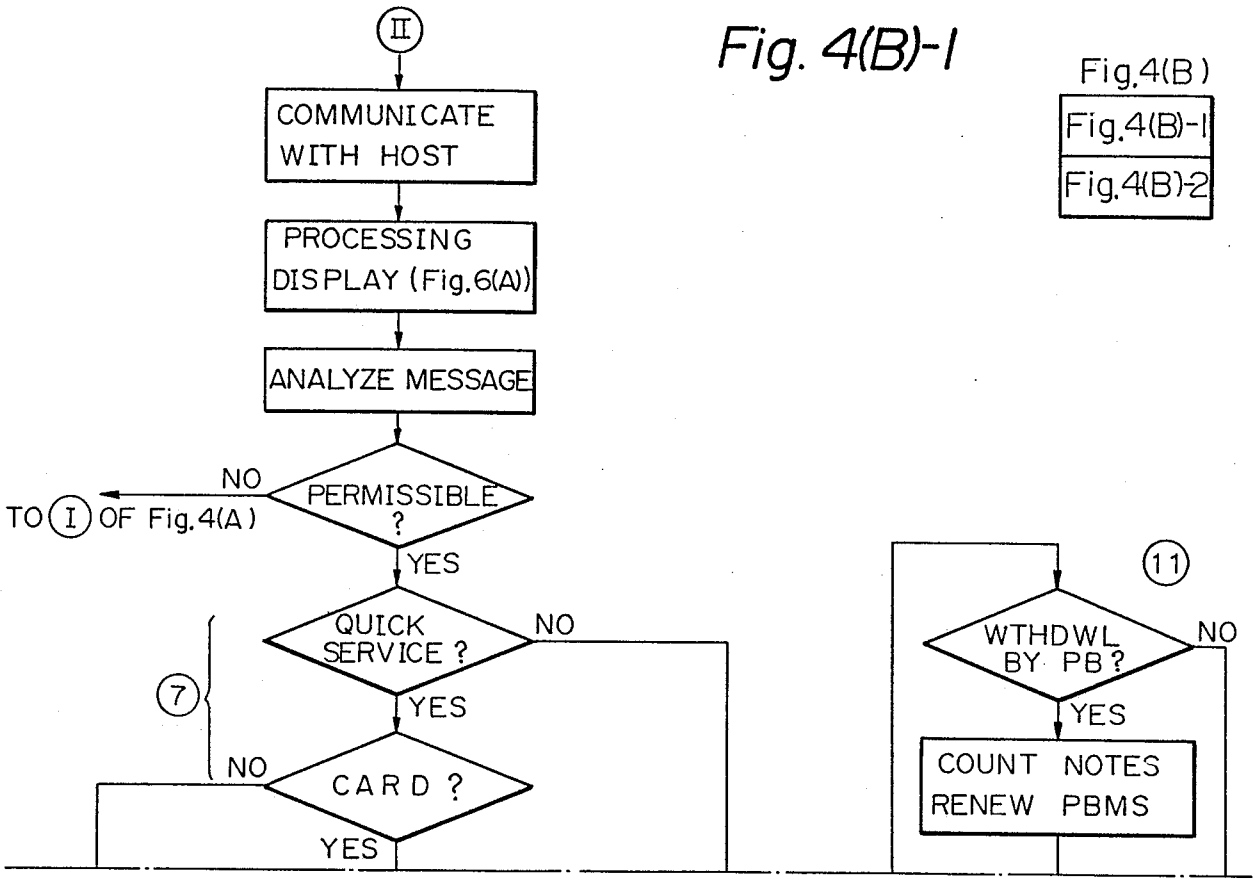
Figures 2, 4B:
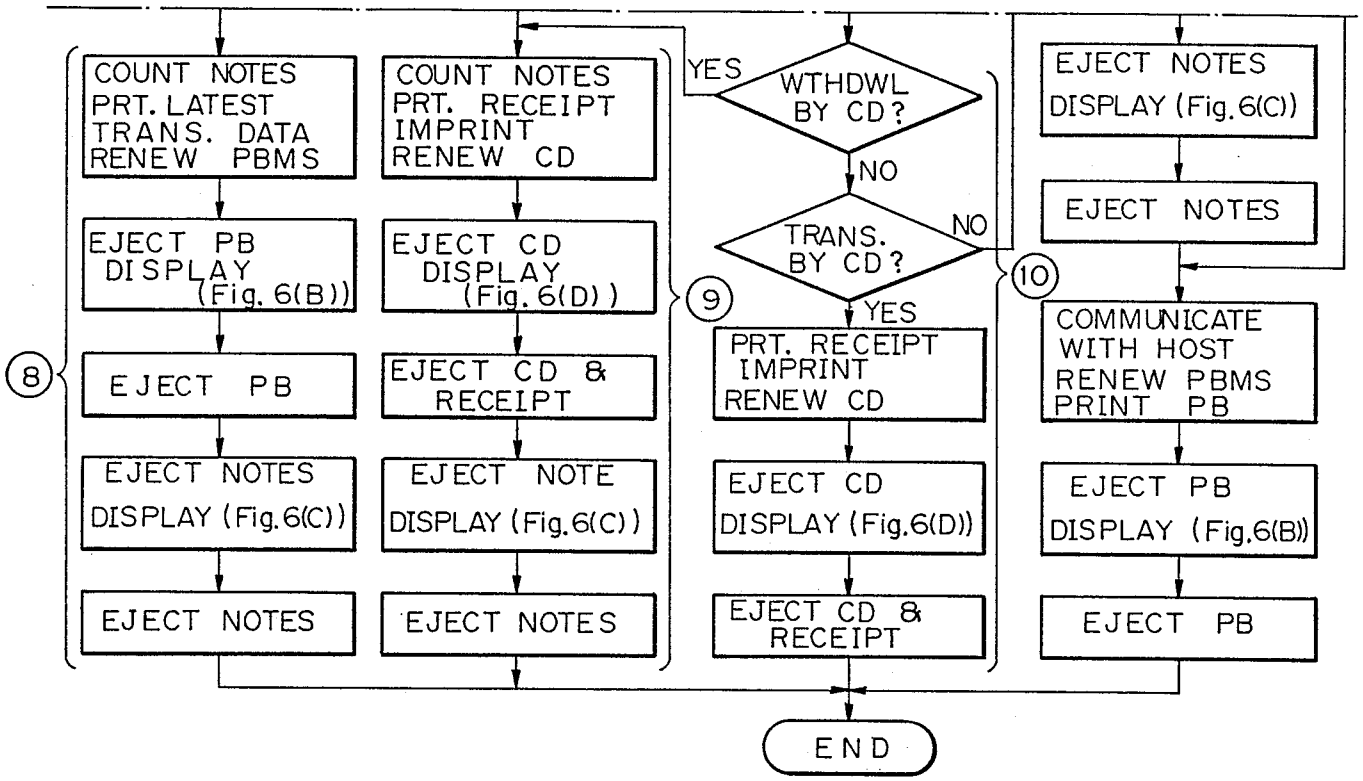

A flow chart of an embodiment of the present invention is shown spanning FIGS. 4(A) and 4(B). The various displays for guiding the operation in FIGS. 4(A) and 4(B) are illustrated in FIGS. 5 and 6. The different printing modes are illustrated in FIGS. 7 and 8.

In this embodiment, two transaction modes are selectable in a withdrawal transaction, which is the most frequently used transaction in the automatic machine. One is a first transaction mode which executes a quick service transaction, and the other is a second transaction mode which executes an ordinary transaction. Transactions other than withdrawals, such as deposit and balance inquiry, are executed only in the ordinary transaction mode (second transaction mode).

Figure 5A:
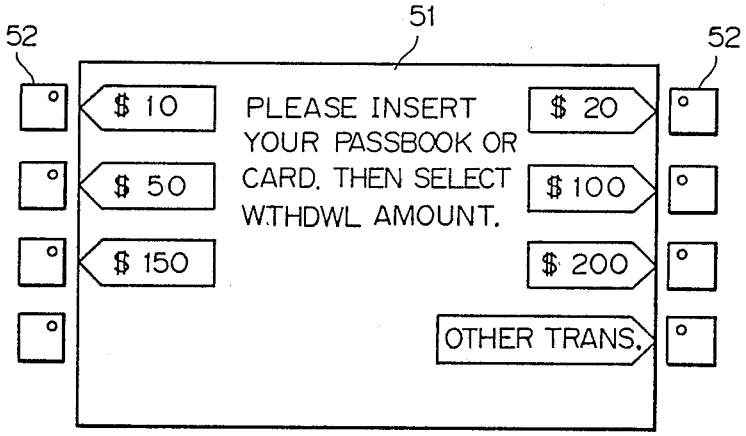
FIGS. 5(A)–5(D) and FIGS. 6(A)–6(E) are explanatory views of the display by the automatic machine used in the present invention.

(1) In the waiting state before a card insertion, a display of the quick service operation as illustrated in FIG. 5(A) is shown on the display 51 of the operation panel 5. This quick service display gives operation guidance lines, such as "insert card or passbook" and "press desired transaction service button". Each of the transaction buttons (input-keys) 52 disposed on both sides of the display 51 corresponds to one of the displays of fixed amount of withdrawal, e.g., from $10 to $200, or displays "other transactions".

In this state, a card CD or a passbook PB is inserted into the CIP 1 or PB printer 2, which then reads transaction data written on the magnetic stripe MS. The read data is transmitted to the main controller 60 through the card controller 61 on the PB controller 62 and stored in the magnetic stripe buffer **66*b* in the memory 66**.

The main controller 60 checks the validity of the transaction medium in accordance with the data stored in the magnetic stripe buffer **66*b***, by checking the branch code, validity code, and account number.

Figure 6A:
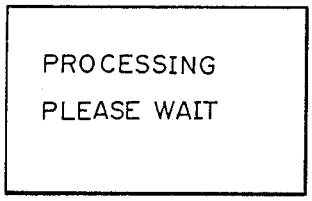
Figure 6B:
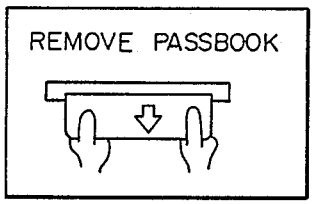
Figure 6C:
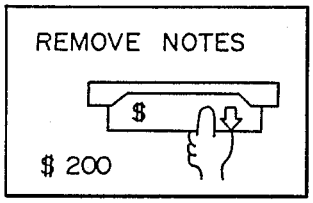
Figure 6D:
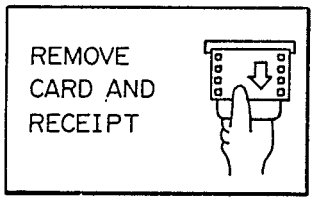
Figure 6E:
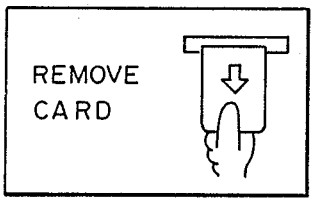

(2) If the validity check shows that the transaction is not permissible, the operation panel 5 shows a card ejection display or a passbook ejection display through the operation controller 65, as illustrated in FIG. 6(B) or 6(E), and the card or passbook is then returned to the user.

(3) On the other hand, if the validity check shows that transaction is permissible, then the main controller 60 checks the grade of the customer from the data in the buffer **66*b***, to determine whether or not a quick service transaction is permissible.

If the quick service transaction is permissible, a quick service withdrawal is registered in the transaction register **66*a* of the memory 66, in order to receive an input from a selected key button 52 in FIG. 5(A). When the user pushes one of the keys 52, the selected transaction input is transmitted to the main controller 60 through the operation controller 65**.

If "other transactions" is selected, the main controller 60 cancels the quick service withdrawal registered in the transaction register 66a and changes (rewrites) it to an ordinary transaction represented in step (4) the flow chart of FIG. 4(A).

On the other hand, if the user selects one of the fixed amount withdrawal buttons (FIG. 5(A)), the main controller 60 compares the input amount with the credit balance CC memorized in the buffer 66b of the memory 66. If the input amount is more than the credit amount, the main controller 60 cancels the quick service transaction and changes a quick service withdrawal registered in the transaction register 66a to the ordinary withdrawal transaction of step (4) the flow chart.

As can be seen from the above explanation, the quick service transaction is limited to the fixed amount withdrawal shown in the display of FIG. 5(A). Withdrawal transactions for amounts other than the displayed amount, or other transactions such as deposit or balance inquiry, are executed in the ordinary transaction mode.

(4) If the quick service transaction is not permissible in step (3), the main controller 60 registers the ordinary transaction in the transaction register 66a of the memory 66.

Figure 5B:
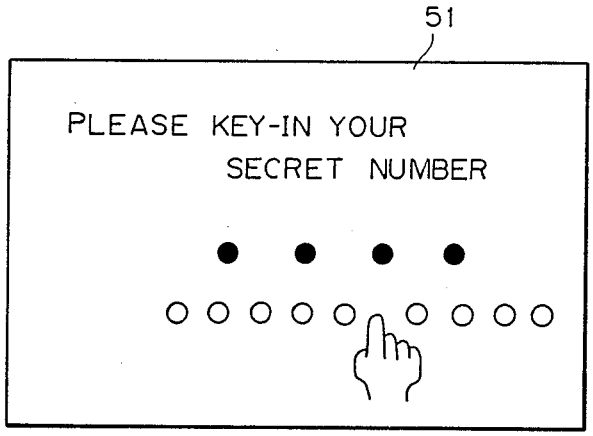

Subsequently, "input secret number" is displayed in the display 51 of the operation panel 5, as illustrated in FIG. 5(B). This display of FIG. 5(B) is also shown when the quick service transaction is cancelled in step (3), as mentioned above.

The secret number for identifying the user is input by the user by pushing second keys 50 (FIG. 2), and the input number is transmitted to the main controller 60 through the operation controller 65. The main controller 60 compares the input secret number with the identification number memorized in the magnetic stripe buffer 66b of the memory 66.

If the input number does not coincide with the registered number, the process goes back to step (2), and the card or the passbook is returned to the user.

Figure 5C:
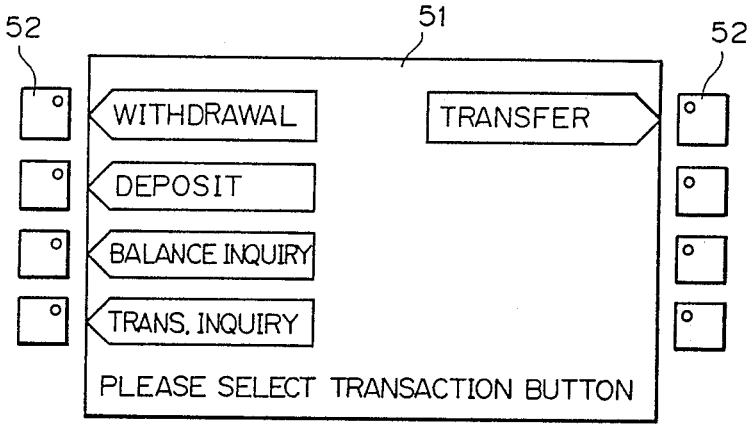

On the other hand, if the input secret number coincides with the registered number, "select service" is displayed in the display 51 of the operation panel 5, as illustrated in FIG. 5(C). The user pushes a desired input key 52 selected from among the "withdrawal", "deposit", "balance inquiry", "transaction inquiry", and "transfer funds" keys.

Figure 5D:
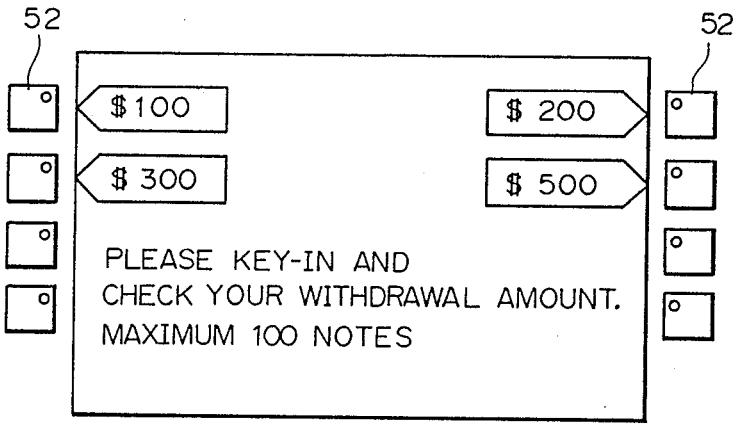

If the user selects the withdrawal transaction, the main controller 60 registers the ordinary withdrawal transaction in the register 66a and displays a withdrawal amount selection display, as illustrated in FIG. 5(D), on the display 51 of the operation panel 5. The display of FIG. 5(D) shows a fixed amount of either $100, $200, $300, or $500, which can be input by pushing one of the first input-keys 52. A withdrawal amount other than the displayed fixed amount is input by pushing the second input-keys 50 (FIG. 2).

If a transaction other than "withdrawal" is selected in the display of FIG. 5(C), the main controller 60 registers the selected transaction in the register 66a and executes the selected transaction. For example, if "balance inquiry" or "transaction inquiry" is selected, the process goes to step (5) without further data input. If "deposit" is selected, the envelope depository 4 is driven. If "transfer funds" is selected, the transfer amount and account number must be input.

Accordingly, the input process ends at step (3) or (4).

Figure 7A:
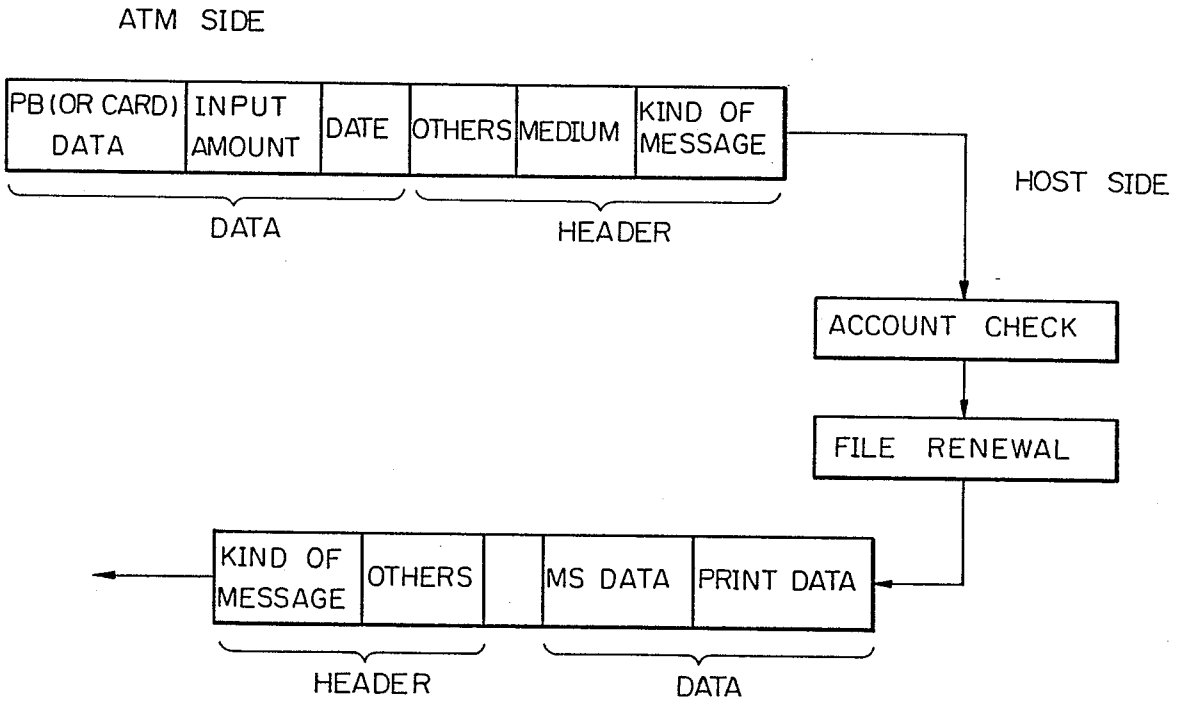

(5) The main controller 60 sends a communication message to the host computer in accordance with the data recorded in the transaction indication register 66a. If the quick service transaction is registered, the communication message comprises a header portion (kind of message (quick trans.), kind of medium) and a data portion (data, input amount, PB (or card) data), as illustrated in FIG. 7(A). If the ordinary transaction is registered, the communication message comprises a header portion (kind of message (ordinary trans.), kind of medium) and a data portion (data, input amount, input secret number, PB (card) data), as illustrated in FIG. 8(A).

(6) The main controller 60 transmits the communication message to the host computer through the circuit controller 67, and the display 51 of the operation panel 5 displays "Processing Please Wait", as illustrated in FIG. 6(A).

Figure 8A:
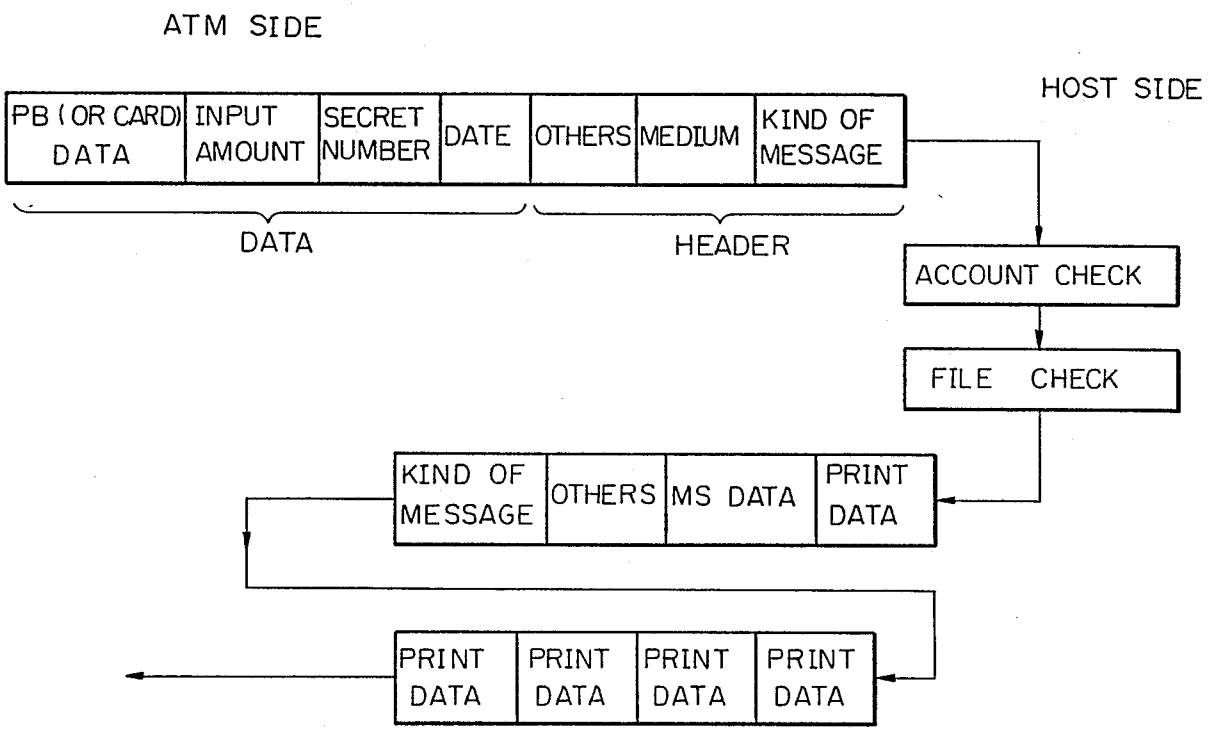
Figure 9:
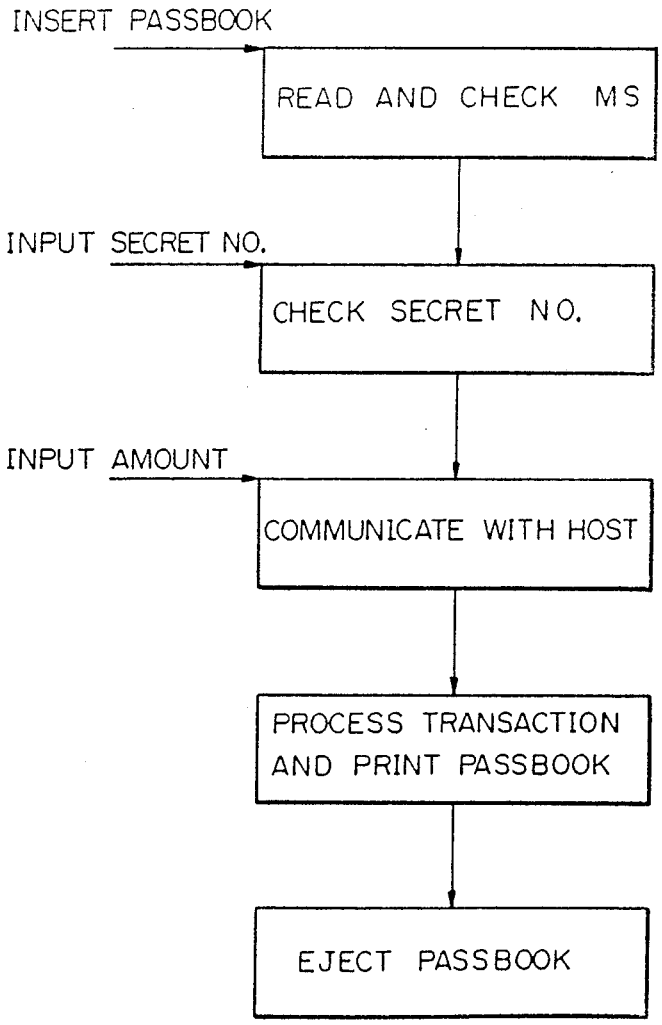
Fig. 9 (Prior Art)

When receiving the message shown in FIG. 7(A) or 8(A), the host computer checks the user's account recorded in the account file and decides to whether or not to permit the transaction. The host computer then renews the user's file. Subsequently, the host computer transmits a transaction permission/rejection message to the main controller through the circuit controller 67. The main controller 60 stores the message in the communication buffer 66c, and then analyzes the message.

If a transaction rejection message is included in the header portion of the message to the main controller 60, the process returns to step (2) of FIG. 4(A) and the card or passbook is ejected.

(7) If a transaction permission message is transmitted to the main controller 60, the main controller 60 determines the kind of transaction from the data recorded in the transaction register 66a, and if a process other than the quick service transaction is desired, the flow goes to step (9).

(8) In the quick service transaction using a passbook, the main controller 60 drives the cash counter 3 to count the required amount of bills through the dispense controller 63, in accordance with the message from the host computer and the input withdrawal amount recorded in step (3).

At the same time, the magnetic stripe data and the printing data are transmitted to the passbook controller 62 which drives the passbook printer 2 to renew the data of the magnetic stripe and print the data in the passbook.

The printing data transmitted from the host computer includes only the latest data of the transaction now under execution. Therefore, the brief printing mode wherein only the latest transaction data is printed is executed in the quick service transaction. Namely, even if there is data recorded in the file of the host computer, and data is not printed in the passbook, the not-printed data of the former transactions is not transmitted to the main controller. Therefore, the printing time is shortened in the quick service transaction. In this printing process, the balance is not printed to avoid confusing the user, since the former transaction data is not printed on the passbook.

The display 51 then displays "remove passbook", as illustrated in FIG. 6(B) and the passbook is ejected from the PB printer 2.

The display 51 then displays "remove notes", as illustrated in FIG. 6(C), the required amount of notes is ejected from the cash counter 3, and thus the transaction is completed.

(9) In the withdrawal transaction using a card instead of the passbook in step (7), the main controller 60 transmits required withdrawal amount input in step (3) the dispense controller 63 and drives the cash counter 3 to count the required amount of cash.

At the same time, the main controller 60 drives the CIP 1 through the card controller 61 to imprint the embossing of the card on the receipt and print the data on the receipt and renew the magnetic stripe MS.

The display 51 then displays "remove card", as illustrated in FIG. 6(D), and the card and the receipt are ejected from the CIP 1.

Then the display 51 displays "remove notes", as illustrated in FIG. 6(C), and the required amount of notes is ejected from the cash counter 3, and thus the transaction is completed.

(10) In an ordinary transaction other than the quick service transaction in step (7), the main controller 60 determines the kind of transaction and medium from the data recorded in the transaction register 66*a*. In the case of a card withdrawal transaction, the process is executed in accordance with step (9), and in the case of a passbook transaction, the process goes to step (11).

In the case of a card transaction other than a card withdrawal transaction, the main controller 60 drives the CIP 1 through the card controller 61 to imprint the embossing the card or the receipt and print the data on the receipt and renew the data recorded in the magnetic stripe MS.

The display 51 then displays "remove card and receipt", as illustrated in FIG. 6(D), and the card and the receipt are ejected from the CIP 1, and thus the transaction process is ended.

(11) In the case of a transaction other than the card transaction in step (10), the process is executed according to whether or not the transaction is a withdrawal.

In the case of a withdrawal transaction using a passbook, the main controller 60 drives the cash counter 3 through the dispense controller 63 to count the required amount of cash, and at the same time, the main controller 60 drives the passbook printer 2 through the passbook controller 62 to renew the data of the magnetic stripe of the passbook The display 51 then displays "remove notes", as illustrated in FIG. 6(C), and the required amount of notes is ejected from the cash counter 3. The process then goes to the passbook printing step.

In the printing step of the transaction other than the quick service transaction using the passbook, the former transaction data recorded in the file of the computer, but not printed in the passbook, is printed in the passbook together with the data of the latest transaction now under execution, as illustrated in FIG. 8(B).

The display 51 then displays "remove passbook", as illustrated in FIG. 6(B), and the passbook is ejected from the passbook printer 2, and thus the process is ended.

As mentioned above, in the quick service transaction, only a fixed withdrawal amount transaction is possible, so that the input operation is simply done by pushing one of the input-keys 52 of FIG. 5(A). Also, in the quick service transaction, only the data of the latest transaction is printed in the passbook. Therefore, the input manipulation becomes very easy and the printing time is shortened, which reduces the overall transaction time.

On the other hand, in the ordinary transaction, any desired withdrawal amount and transactions other than a withdrawal are made possible by inputting a secret number and the transaction amount in the conventional way. Also, all of the not-printed data of former transactions is printed in the passbook in the same manner as in the conventional printing mode.

When the quick service transaction is permissible, the user can select the other transactions in step (3) of using the quick service transaction mode, whereby the user can indicate any desired withdrawal amount and print the former not-printed data in the passbook in accordance with the ordinary printing mode.

Further, in the case of the quick service transaction, the service mode is automatically changed to the ordinary transaction if the withdrawal amount is more than the users credit balance, which guarantees the transaction security since the user must be identified by a secret number.

The credit balance is the maximum withdrawal amount by the quick service operation in one day or during a predetermined number of days, and is renewed after every quick service transaction.

It is possible for the user to command a print-out in the brief printing mode by manipulating an input means, when desired, instead of automatically commanding the brief printing mode by reading the grade of customer recorded in the magnetic stripe of the card or the passbook.

It is also possible to apply the brief printing mode to an automatic machine which executes only withdrawal transactions, instead of the above mentioned multi-function automatic machine of FIG. 2.

Further, it is possible to apply the brief printing mode to an automatic machine which always requires an input of a secret number, as in step (4) of FIG. 4(A), and does not offer the quick service transaction. In this case, the user commands a print-out in the brief printing mode or the ordinary printing mode by manipulating an input means such as selection key button.

If will be obvious to a person skilled in the art that the present invention can be used in various other ways, within the scope of the claims.

As mentioned above, in accordance with the present invention, it is possible to command a print-out in the brief printing mode, when desired, wherein only the latest transaction data is printed in the passbook without printing-out the not-printed data of former transactions, which reduces the printing time, and thus shortens the transaction time.

Also, it is possible to select the ordinary printing mode if the user wishes to be informed of the data of the former transactions, and this does not adversely affect the function of showing the history of the passbook.

I claim:

1. A passbook printing machine used for automatic transactions in the field of banking which executes a transaction by user manipulation with the use of a passbook which is inserted into the machine immediately before the transaction and which is returned to the user after transaction data is printed therein, the machine comprising:

a printer for printing said transaction data in said passbook in a brief printing mode or in an ordinary printing mode;

said printer printing only a latest transaction data in said passbook in said brief printing mode, and said printer printing not-printed former transaction data in addition to said latest transaction data in said ordinary printing mode, one of said printing modes being selectively executed in response to a single user manipulation, means coupled to the printer for storing not-printed transaction data, reading the not-printed transaction data, and producing transaction data of a transaction performed using said passbook;

mode input means coupled to the storing, reading and producing means for selecting either the brief printing mode or ordinary printing mode, and means for judging the selected mode to switch the transaction data to be fed to the printer.

2. A passbook printing machine according to claim 1, wherein said brief printing mode is automatically selected by reading data of a grade of a customer recorded in a recording medium attached to said passbook.

3. A passbook printing machine according to claim 1, further comprising a keypad, having a plurality of keys, connected to said mode input means, wherein said mode input means includes means for selecting said brief printing mode based upon user manipulation of a single key on said keypad.

4. An automatic transaction bank machine, comprising:

printing means for printing information in first and second printing modes; and control means for selecting either said first or said second printing mode, said first printing mode immediately printing only information relating to a current transaction without printing a balance and said second printing mode printing information relating to all transactions not previously printed and including a balance reflecting all previous transactions and the current transaction.

5. A machine as recited in claim 4, further comprising:

data reading means for reading data stored on magnetic strips, said data reading means reading data stored on a magnetic strip attached to a passbook, said first printing mode being automatically selected based on data read by said data reading means from said magnetic strip attached to said passbook.

6. A machine as recited in claim 4, further comprising input means for inputting commands to said machine manually input by a user, wherein said first printing mode is selected based on a single manually input command.

7. A passbook printing machine of an automated banking system which includes an operation panel and a host computer for storing all transaction data for a given passbook including a balance reflecting both a not-printed transaction data and previously printed transaction data, the machine comprising:

a printer coupled to the computer and having the passbook inserted therein prior to initiating a latest data of transaction to be executed;

means coupled to the host computer, for selecting either a brief printing mode in which only the latest data of transaction is printed without printing the balance or a regular printing mode in which the latest data of transaction is printed with the balance, along with previously not-printed transaction data; and means responsive to the selected mode to switch the transaction data to be fed to the printer from the host computer.

8. A passbook printing machine used for automatic transactions in the field of banking which executes a transaction by user manipulation with the use of a passbook which is inserted into the machine immediately before the transaction and which is returned to the user after transaction data is printed therein, the machine comprising:

a printer for printing said transaction data in said passbook in a brief printing mode or in an ordinary printing mode;

said printer printing only a latest transaction data in said passbook in said brief printing mode, and said printer printing not-printed former transaction data in addition to said latest transaction data in said ordinary printing mode, one of said printing modes being selectively executed in response to a single user manipulation, means coupled to the printer for storing not-printed transaction data, reading the not-printed transaction data, and producing transaction data of a transaction performed using said passbook;

mode input means coupled to the storing, reading and producing means for selecting either the brief printing mode or ordinary printing mode, and means for judging the selected mode to switch the transaction data to be fed to the printer, wherein said brief printing mode is automatically selected by reading data of a grade of a customer recorded in a recording medium attached to said passbook.

9. A passbook printing machine used for automatic transactions in the field of banking which executes a transaction by user manipulation with the use of a passbook which is inserted into the machine immediately before the transaction and which is returned to the user after transaction data is printed therein, the machine comprising:

a printer for printing said transaction data in said passbook in a brief printing mode or in an ordinary printing mode;

said printer printing only a latest transaction data in said passbook in said brief printing mode, and said printer printing not-printed former transaction data in addition to said latest transaction data in said ordinary printing mode, one of said printing modes being selectively executed in response to a single user manipulation, means coupled to the printer for storing not-printed transaction data, reading the not-printed transaction data, and producing transaction data of a transaction performed using said passbook, mode input means coupled to the storing, reading and producing means for selecting either the brief printing mode or ordinary printing mode, means for judging the selected mode to switch the transaction data to be fed to the printer, and a keypad, having a plurality of keys, connected to said mode input means, wherein said mode input means includes means for selecting said brief printing mode based upon user manipulation of a single key on said keypad.

10. An automatic transaction bank machine, comprising:

printing means for printing information in first and second printing modes;

control means for selecting either said first or said second printing mode, said first printing mode immediately printing only information relating to a current transactions without printing a balance and said second printing mode printing information relating to all transaction not previously printed and including a balance reflecting all previous transactions and the current transaction, and data reading means for reading data stored on magnetic strips, said data reading means reading data stored on a magnetic strip attached to a passbook, said first printing mode being automatically selected based on data read by said data reading means for said magnetic strip attached to said passbook.

11. A machine as recited in claim 10, further comprising input means for inputting commands to said machine manually input by a user, wherein said first printing mode is selected based on said manually input commands.

* * * * *